United States Patent [19]

Inomata et al.

[11] Patent Number: 5,062,726

[45] Date of Patent: Nov. 5, 1991

[54] PROCESS FOR SETTING A CUT PRINTING SHEET

[75] Inventors: Mitsugu Inomata; Fumio Nakao, both of Kawasaki; Takashi Maekawa, Machida; Kaneastu Uchiyama, Hachioji; Tetsu Endo, Komae; Kazuo Nobue, Okayama; Masaki Shimazaki, Kawaguchi; Shigeki Idouji, Inagi, all of Japan

[73] Assignee: Fujitsu Limited, Kawasaki, Japan

[21] Appl. No.: 423,597

[22] Filed: Oct. 17, 1989

Related U.S. Application Data

[63] Continuation of Ser. No. 279,258, Dec. 1, 1988, abandoned, which is a continuation of Ser. No. 927,974, Nov. 7, 1986, abandoned.

[30] Foreign Application Priority Data

Nov. 9, 1985 [JP] Japan ..... 60-249940

[51] Int. Cl.[5] ..... B41J 13/26

[52] U.S. Cl. ..... 400/630; 400/624; 400/579

[58] Field of Search ..... 400/630, 551, 568, 620, 400/624, 625, 629, 636, 639.1, 579; 271/226, 227

[56] References Cited

U.S. PATENT DOCUMENTS

| | | | |
|---|---|---|---|
| 3,844,395 | 10/1974 | Mero | 400/620 |
| 4,195,940 | 4/1980 | Rekewitz | 400/568 |
| 4,248,415 | 2/1981 | Steinhilber | 400/629 X |
| 4,326,815 | 4/1982 | Kapp | 400/625 |
| 4,565,462 | 1/1986 | Yamamoto | 400/629 X |
| 4,687,362 | 8/1987 | Runzi | 400/624 X |

FOREIGN PATENT DOCUMENTS

| | | | |
|---|---|---|---|
| 37451 | 2/1986 | Japan | 400/630 |
| 83/03075 | 9/1983 | World Int. Prop. O. | 400/579 |

*Primary Examiner*—David A. Wiecking

*Attorney, Agent, or Firm*—Armstrong, Nikaido, Marmelstein, Kubovcik, & Murray

[57] ABSTRACT

A printer comprises a cylindrical platen for supporting and feeding a printing sheet, a pinch roller in resilient contact with the platen to cooperate therewith to feed the cut sheet, and an inclined sheet guide on which a cut sheet is loaded. A leading edge of the cut sheet is inserted into a space between the platen and the pinch roller so that the cut sheet is ready to be compulsorily fed by the platen. When or after a cut sheet is loaded on the sheet guide, the platen is rotated in the reverse direction by a predetermined amount of rotation and then rotated in the forward direction to set the cut sheet at a given print start position. During the reverse rotation of the platen, the leading edge of the cut sheet is pushed up so that the posture of the cut sheet is corrected.

3 Claims, 3 Drawing Sheets

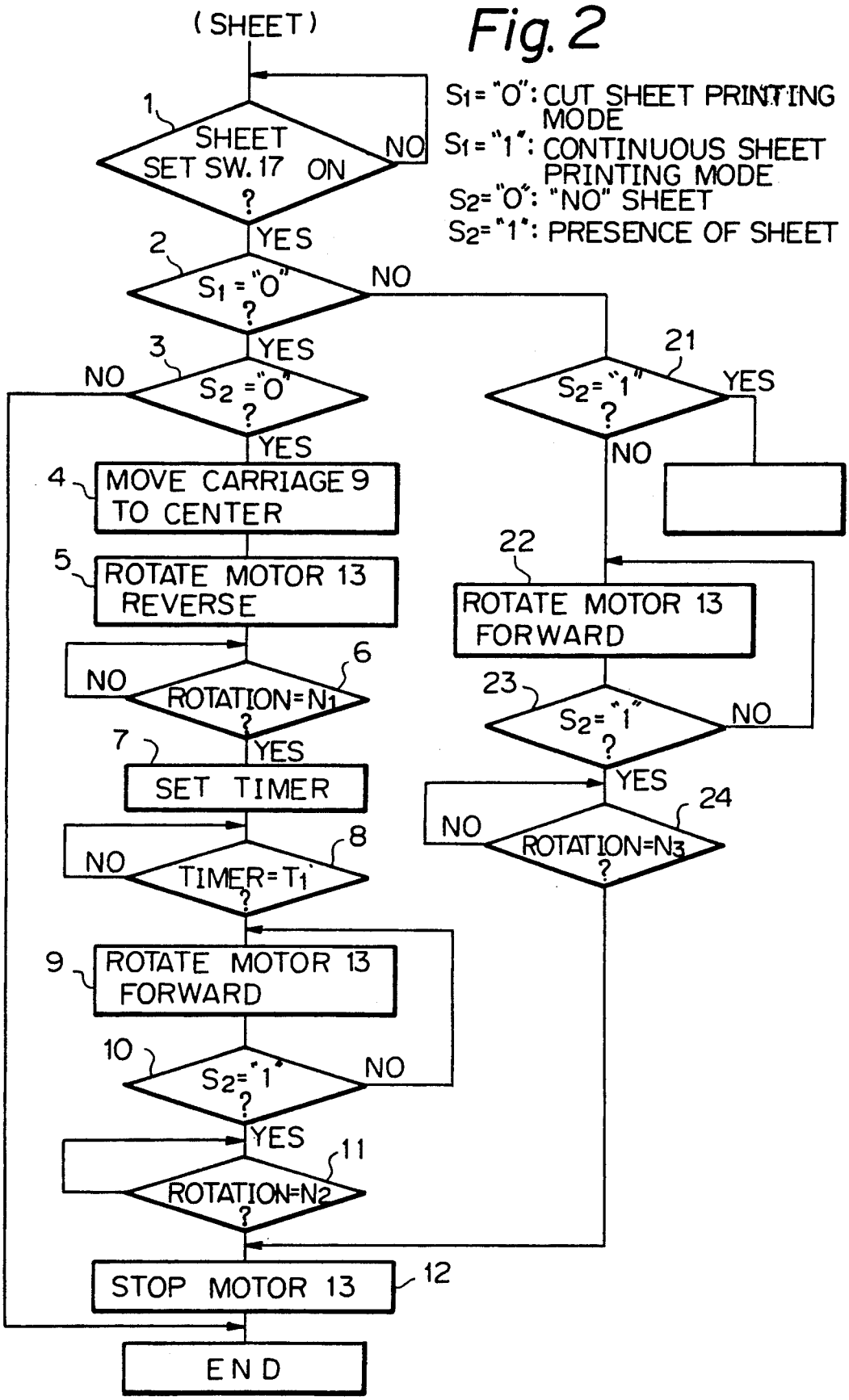
Fig. 2
(SHEET)
S1 = "0": CUT SHEET PRINTING MODE
S1 = "1": CONTINUOUS SHEET PRINTING MODE
S2 = "0": "NO" SHEET
S2 = "1": PRESENCE OF SHEET
1
SHEET SET SW. 17 ON ?
NO
YES
2
S1 = "0" ?
NO
YES
3
S2 = "0" ?
NO
YES
4
MOVE CARRIAGE 9 TO CENTER
5
ROTATE MOTOR 13 REVERSE
6
ROTATION=N1 ?
NO
YES
7
SET TIMER
8
TIMER=T1 ?
NO
9
ROTATE MOTOR 13 FORWARD
10
S2="1" ?
NO
YES
11
ROTATION=N2 ?
12
STOP MOTOR 13
END
21
S2="1" ?
YES
NO
22
ROTATE MOTOR 13 FORWARD
23
S2="1" ?
NO
YES
24
ROTATION=N3 ?
NO

PROCESS FOR SETTING A CUT PRINTING SHEET

This application is a continuation of application Ser. No. 279,258 filed Dec. 1, 1988, which is a continuation of application Ser. No. 927,974 filed Nov. 7,1986, both now abandoned.

BACKGROUND OF THE INVENTION

1. Field of the Invention

This invention relates to a printer, and more particularly to a process for setting a printing sheet, especially an individual or cut paper, form, or sheet, hereinafter referred to as "cut sheet", which is prevented from being inclined when inserted into the printer and set in a proper print start position.

2. Description of the Related Art

A cut sheet printer usually comprises a cylindrical platen and a pinch roller resiliently in contact with the platen. After a cut sheet is loaded on the printer, the platen is rotated by a line feed controller according to an instruction for feeding the cut sheet. Therefore, the platen cooperates with the pinch roller to feed the cut sheet in the forward direction along a sheet transport passage having a guide member. A sheet sensor is provided, along the sheet transport passage, by which the presence of the sheet is confirmed. When the sheet is fed by a given distance after the sheet sensor detects a front of leading edge of the sheet, the platen is stopped to set the sheet at a print start position.

If, however, the sheet was inclined while being transported, printing would not properly be carried out. That is, the printing would be carried out along an inclined transverse line, or the printing sheet might be crumpled or jammed. Therefore, it is important to prevent the printing sheet, especially a cut sheet, from being inclined.

To prevent a cut sheet from being inclined, it is known in the prior art that two sheet sensors 101A and 101B are provided in a sheet transport passage, as shown in FIG. 4. These two sensors 101A and 101B are arranged along a transverse line perpendicular to the feeding direction of the cut sheet 100. If the sheet 100 is inclined, as shown in FIG. 5, when one of the sensors 101A detects the sheet, the other sensor 101B does not detect the same. In such a printer known in the prior art, if a difference between the detection timings by these two sensors 101A and 101B exceeds a predetermined value, i.e., if the sheet is inclined, the sheet is discharged without being printed.

This printer can only discharge the printing sheet if inclined, but cannot correct the inclined sheet to a proper feeding state. Therefore, a printer having a means for automatically correcting an inclined sheet has long been desired.

SUMMARY OF THE INVENTION

Accordingly, an object of the present invention is to provide a printer, capable of automatically correcting a cut sheet, if transported in inclined state.

Another object of the present invention is to provide a printer, capable of correctly setting the cut sheet at a print start position.

In the present invention, there is provided a process for setting a cut printing sheet in a printer, said printer comprising a cylindrical platen for supporting and feeding the printing sheet, at least one pinch roller, in at least a cut sheet printing mode of the printer, resiliently in contact with said platen to cooperate therewith to feed the cut sheet, an inclined sheet guide member on which a cut sheet is loaded, where a leading edge of the cut sheet is inserted into a space between said platen and the pinch roller so that the cut sheet is ready to be compulsorily fed by the platen and the pinch roller, means for driving said platen, and means for detecting whether a cut sheet is loaded on said sheet guide member or not, characterized in that, said cut sheet setting process comprises a step for rotating said platen in the reverse direction by a predetermined amount of rotation, when the loading of the cut sheet on said sheet guide member is confirmed by said sensor, and said platen is then rotated in the forward direction to set the cut sheet at a given print start line position.

According to the reverse rotation of the platen, even if the cut sheet 8 is inclined with respect to the proper feeding direction, the front or leading edge of the cut sheet is pushed up by the platen rotating in the reverse direction, so that the cut sheet is corrected to assume its normal posture. The possible vibration of the platen and the pinch rollers serves to facilitate the correction of the posture of the cut sheet.

BRIEF DESCRIPTION OF THE DRAWINGS

FIG. 2 is a flow chart illustrating a process for setting a cut sheet according to an embodiment of this invention;

DESCRIPTION OF THE PREFERRED EMBODIMENTS

Figure 1:
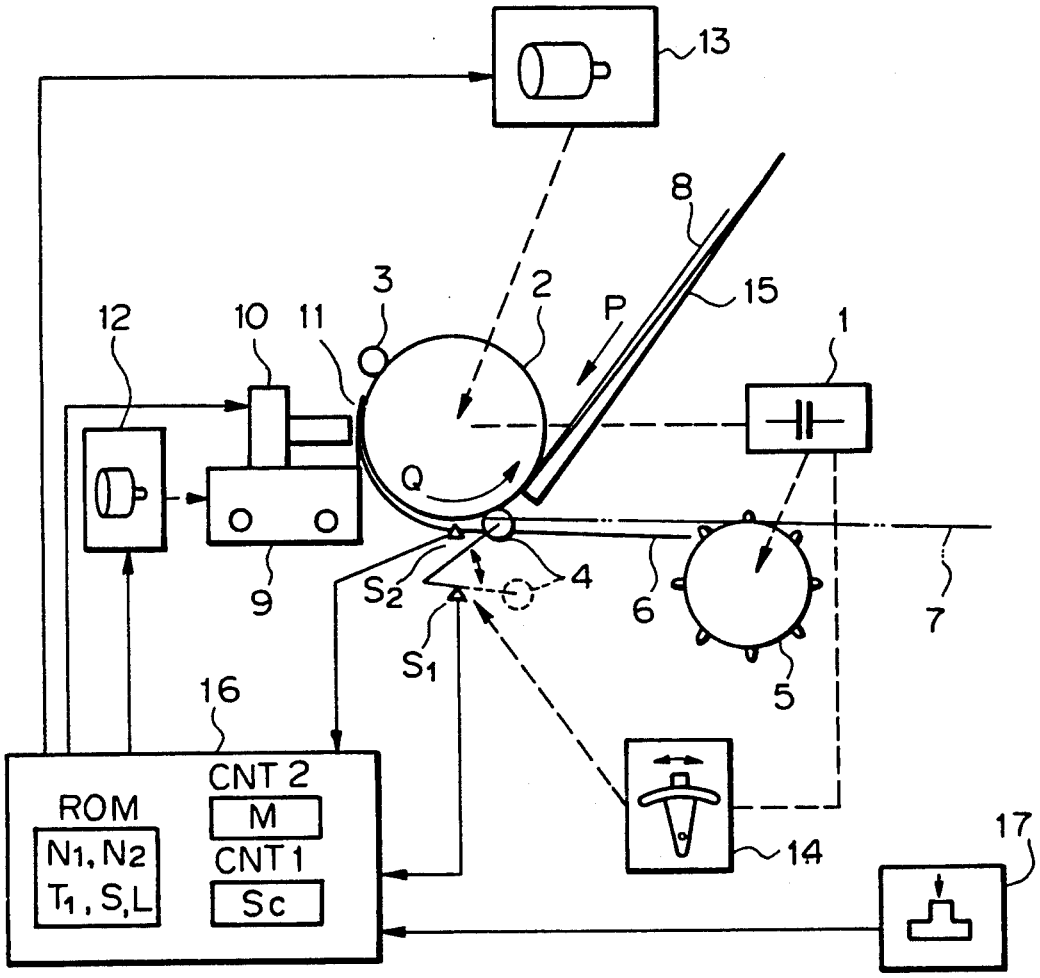
FIG. 1 is a schematic view illustrating a printer according to this invention.

Referring now to FIG. 1, a printer according to the present invention is shown. In FIG. 1, reference numeral 1 indicates a clutch; 2, a cylindrical platen; 3, a bail roller; 4, pinch rollers (also seen from FIG. 3); 5, sprockets for feeding a continuous sheet; 6, a sheet guide for continuous sheet; 7, a continuous sheet; 8, a cut sheet; 9, a carriage; 10, a printing head; 11, a paper guide; 12, a space motor; 13, a line feed motor; 14, a change lever for continuous or cut sheets; 15, a guide for cut sheets; 16, a printer controller for controlling the line drive, carriage drive, and printing head drive; 17, a paper set switch; ROM, a read-on memory; CNT1, a counter for a present position; CNT2, an integrating line feed counter; $S_1$, a sensor for detecting a continuous or cut sheet printing mode; and $S_2$, a sheet sensor.

Figure 3:
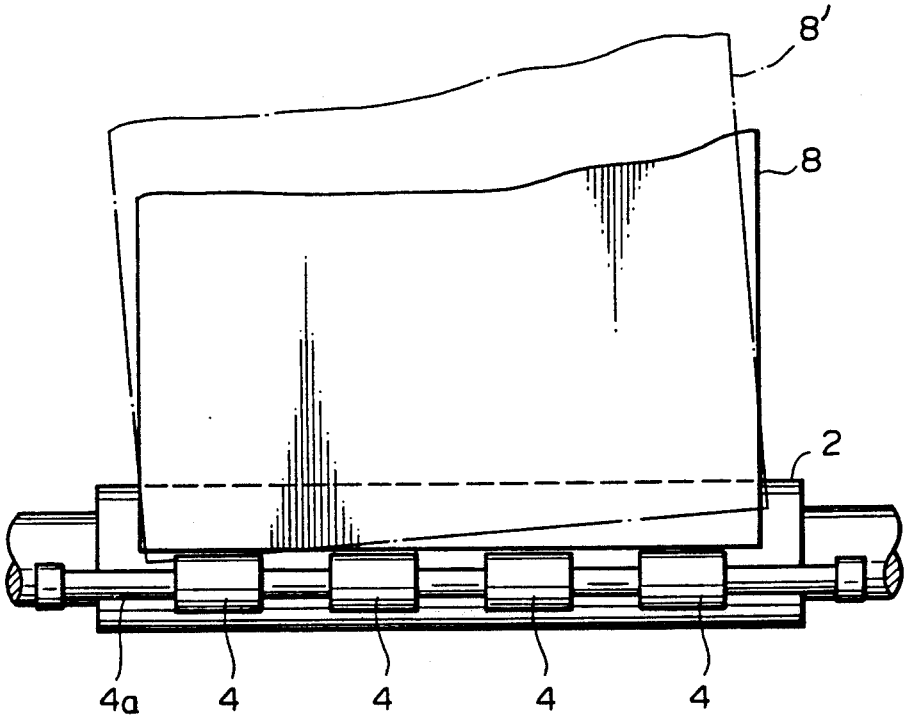
FIG. 3 is a schematic view illustrating a process for correcting an inclined cut sheet.
Figure 4:
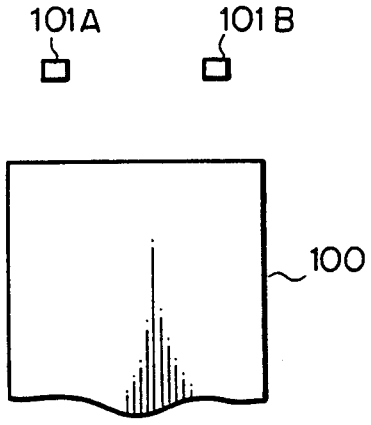
Fig. 4 (PRIOR ART)
FIG. 4 is a view illustrating the arrangement of sheet sensors according to a prior art; and, FIG. 5 is a view illustrating a process for detecting an inclined cut sheet according to the same prior art.
Figure 5:
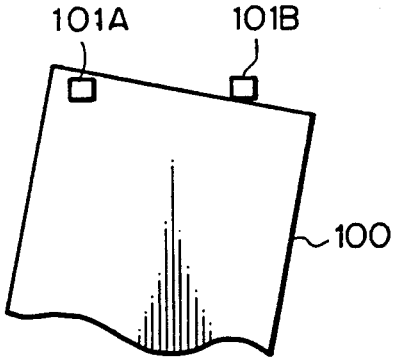
Fig. 5 (PRIOR ART)

The cylindrical platen 2 serves to support and feed either a continuous printing sheet 7 or a cut printing sheet 8. The pinch rollers 4 are freely rotatably mounted on a roller shaft 4*a* (FIG. 3). The print mode, i.e., a continuous or cut sheet printing state, can be changed by the lever 14.

When the lever 14 is turned in one direction, the pinch rollers 4 come into resilient contact with the plate 2, as shown in a solid line in FIG. 1, and the clutch 1 is turned OFF. In this state, the sensor $S_1$ detects a cut sheet printing mode in which a cut sheet 8 can be treated. In this cut sheet printing mode, the pinch rollers 4 are in resilient contact with the platen 2, as mentioned above, to cooperate therewith to feed the cut sheet 8 in a line feed direction, as indicated by an arrow P in FIG. 1. At least in this cut sheet printing mode, the cut sheet guide 15 is mounted on the printer so as to be inclined, as seen from FIG. 1, so that, when a cut sheet is loaded on the guide 15, a leading or front end of the cut sheet is inserted into a space between the platen 2 and the pinch rollers 4 by the force of gravity so that the cut sheet 8 is ready to be compulsorily fed by the platen 2. On the other hand, in this mode, the sprocket 5 for transporting the continuous printing sheet 7 is released from its driving source by turning OFF the clutch 1. Under this condition, a cut sheet 8 can be loaded and printed.

The cut sheet setting process in this mode will now be described with reference to FIG. 2. In FIG. 2, $S_1$="0"; a cut sheet printing mode $S_1$="1"; a continuous sheet printing mode $S_2$="0"; sheet absent condition $S_2$="1"; sheet present condition $N_1$, $N_2$, $N_3$, and $T_1$ are stored in a ROM (in FIG. 1) in the printer controller 16.

If cut sheets 8 are to be printed, a single blank cut sheet 8 is loaded on the sheet guide 15 and the sheet set switch 17 is depressed indicating that a cut sheet is loaded on the sheet guide. This depression of the switch 17 is confirmed (step 1) and then the cut sheet printing mode is also confirmed by the sensor $S_1$, i.e., $S_1=0$, (step 2). These confirmations are conducted in the printer controller 16. Then, the absence of a sheet at the position where the sensor $S_2$ is located, is confirmed by the sensor $S_2$ per se, i.e., $S_2=0$, (step 3). Then, the carriage 9 is moved to a centering position by the space motor 12 (step 4). This movement of the carriage 9, i.e., the carriage 9 is located at the centering position, serves to facilitate that the paper guide 11 mounted on the carriage 9 correctly guides a front end of the cut sheet 8 while the sheet 8 is transported to a print start position. Then, the line feed motor 13 is rotated in the reverse direction by the instruction from the printer controller 16 (step 5), and therefore, the platen 2 is also rotated in the reverse direction, as shown by an arrow Q in FIG. 1. This reverse rotation of the platen 2 is stopped after a predetermined amount of rotation ($N_1$) is attained (step 6).

According to the reverse rotation of the platen 2, even if the cut sheet 8, which has been already inserted between the platen 2 and the pinch rollers 4 along the paper guide 15, is inclined with respect to the proper feeding direction, as seen at 8' in FIG. 3, the front or leading edge of the cut sheet 8 is pushed up by the platen 2 rotating in the reverse direction, so that the normal posture of the cut sheet 8 is obtained, as shown by a solid line (8) in FIG. 3. That is, while the platen 2 is rotated in the reverse direction, the leading edge of the cut sheet 8 is corrected to align with a transverse contact line between the platen 2 and the pinch rollers 4, and then the posture of whole the cut sheet 8 is corrected on the basis of the aligned leading edge. The possible vibration of the platen 2 and the pinch rollers 4 serves to facilitate the correction of the posture of the cut sheet 8.

After that, the platen 2 is stopped for a predetermined time period $T_1$ (step 8) which is previously set in the timer (step 7). The time period $T_1$ provides sufficient time for the correction of the cut sheet 8 to be completed. Then, the platen 2 is rotated (step 9) in the forward direction by the line feed motor 13 until, after the sheet sensor $S_2$ detects the presence of the sheet, i.e., $S_2=1$, (step 10), a predetermined amount of rotation $N_2$ is attained (step 11). The line feed motor 13 is then stopped at a position (step 12) where the cut sheet 8 is to be set on a predetermined print start position. At step 3, if the cut sheet 8 is present, i.e., $S_2=1$, the operation is returned to the end, since it is not necessary to set the cut sheet 8.

According to the above-mentioned embodiment, the platen 2 is stopped for a predetermined time interval after it is rotated in the reverse direction. However, the platen 2 may not be stopped, but may be transported in the forward direction, just after it is rotated in the reverse direction. Also, the reverse rotation of the platen 2 may be intermittently executed. Depending on the size, shape, or material of the cut printing sheet 8, the intermittent reverse rotation may be a particularly favorable method.

On the other hand, in a continuous sheet printing mode, the change lever 14 is not turned toward the cut sheet printing mode and the pinch roller 4 is located in a position indicated by a dotted line in FIG. 1. In this mode, when the clutch 1 is turned ON, the sprockets 5 are driven in the forward direction. When the printing mode is confirmed by the sheet sensor $S_1$ (step 2) after the depression of the sheet set switch 17 is confirmed (step 1), if the continuous sheet printing mode is confirmed, i.e., $S_1=1$, a presence of the continuous sheet is then confirmed (step 21). If the continuous sheet 7 is not present, i.e., $S_2=0$, the line feed motor 13 is driven to rotate the platen 2 in the forward direction (step 22). In this case, the sprocket 5 is also rotated together with the platen 2 and the inserted continuous sheet 7 is guided and fed along the sheet guide 6. The sprockets 5 and the platen 2 are rotated until a predetermined amount of rotation $N_3$ is attained (step 24) after the sheet sensor $S_2$ detects the presence of the continuous sheet 7, i.e., $S_2=1$, (step 23). After the completion of this rotation of the sprockets 5 and the platen 2, they are stopped at a position (step 12) where the continuous sheet 7 is to be set at a predetermined print start position. At step 21, if the continuous sheet 7 is present, i.e., $S_2=1$, the operation is no longer continued, since it is not necessary to set the continuous sheet 7.

After the printing sheet 7 or 8 is set at a predetermined print start position as mentioned above, the carriage 9 is moved in the transverse direction and the printing heads 10 mounted thereon are operated according to printing instructions from the controller 16 in a known manner. During the printing operation, line feed of the printing sheet is carried out by the line feed motor 13, also in known manner.

In a conventional printer known in the prior art, a printing sheet, especially a cut printing sheet, must be fed to a line position (print start position) at which a front or leading edge thereof is grasped between the bail rollers 3 and the platen 2 and printing is conducted from this line position. Therefore, some width of a top blank margin must be formed at the front edge of the printing sheet.

In the conventional printer as mentioned above, if printing was started from the top end of the printing sheet so as to not leave a top blank margin, and if line feeding was executed at the right end position of the sheet, the printing sheet would not be properly fed between the bail rollers and the platen, but might be jammed, because the paper guide mounted on the carriage would not be positioned at the central position with respect to the platen and, therefore, would not sufficiently retain the printing sheet against the platen 2. Usually, only a part of the printing sheet, in the line direction, would be retained by the paper guide.

In order to avoid such a top blank margin, this embodiment of the present invention makes it possible for a print start line to be set at an optional line position including the leading edge of the printing sheet by the following solution.

According to this printer, before the printing sheet 8 comes to the print start line position, the carriage 9 is waiting at the centering position. Also, after the printing is started and until the leading edge of the printing sheet 8 is fully grasped between the bail rollers 3 and the platen 2, the carriage 9 returns to the centering position every time a line feed is necessary. That is to say, at the first line, the carriage 9 transversely moves from the centering position to an initial print position, and after the printing is completed in the first line, the carriage 9 returns to the centering position. After the return of the carriage 9 to the centering position is confirmed, the printing sheet 8 is fed to the next line by the platen 2. In this second line, the carriage 9 also transversely moves from the centering position to an initial print position in the second line. Such operations are repeated until at least the leading edge of the printing sheet 8 is fully grasped between the bail rollers 3 and the platen 2, as mentioned above. Therefore, the printing sheet 8 is fed to the next line only when the paper guide 11, which is also mounted on the carriage 9, is positioned at the central position with respect to the platen 2 and retains the printing sheet 8 against the platen 2. Therefore, the printing sheet 8 is not jammed, but properly guided along the paper guide 11 until the leading edge of the printing sheet 8 is fully grasped between the bail rollers 3 and the platen 2. After that, it is no longer necessary to return the carriage 9 to the centering position before line feed is executed.

In a block of the controller 16 in FIG. 1, S, L, and M relate to the above-mentioned operations.

"S" indicates a predetermined position of the paper guide 11, in the line direction, which is stored in the ROM. Before every line feed is executed, the carriage 9 is positioned at S, where the paper guide 11 is substantially positioned at the center with respect to the platen 2, and thereafter, the line feed is executed. The position of the carriage 9 is counted by the CNT1. Therefore, when the printing of a particular line is complete, if the count value differs from S, the carriage 9 returns to the centering position (S).

"L" indicates a predetermined amount of line feed, which is stored in the ROM.

"M" indicates an accumulated amount of line feed from the print start line position and is counted by CNT2. Comparing this M with the above-mentioned L and returning the carriage 9 to the centering position (S), is repeated until M is equal to L.

We claim:

1. A process for feeding a cut sheet into a printer and aligning said cut sheet with said printer for printing, said printer comprising a cylindrical platen for supporting and feeding the printing sheet, at least one pinch roller, in at least a cut sheet printing mode of said printer, in resilient contact with said platen to cooperate therewith to feed the cut sheet, and an inclined sheet guide on which a cut sheet is loaded, wherein a leading edge of said cut sheet is inserted into a space between said platen and said pinch roller so that the cut sheet is ready to be compulsorily fed by said platen and said pinch roller, means for indicating that a cut sheet is loaded on said sheet guide and means for driving said platen characterized in that, said cut sheet feeding and aligning process comprises the steps of loading a cut sheet on said inclined sheet guide so that said cut sheet is freely supported on said sheet guide and said leading edge thereof is inserted into said space but not pinched between said platen and said pinch roller, rotating said platen in the reverse direction by a predetermined amount of rotation and pushing up said cut sheet in gravity contact at said leading edge with said platen rotating in said reverse direction to correct the posture of said cut sheet on said sheet guide and align the leading edge of said cut sheet with said platen and then rotating said platen in the forward direction and drawing said correct posture cut sheet between said forward direction rotated platen and said pinch roller and setting said cut sheet at a pre-set print start line position.

2. A cut sheet setting process as set forth in claim 1, wherein said platen is stopped for a predetermined time interval after rotation in the reverse direction and then rotated in the forward direction.

3. A cut sheet setting process as set forth in claim 1, wherein said platen is intermittently rotated in the reverse direction.

* * * * *